US008458943B2

(12) United States Patent
Horne

(10) Patent No.: US 8,458,943 B2
(45) Date of Patent: Jun. 11, 2013

(54) ADJUSTABLE FRAMED PICTURE HANGER BACK

(76) Inventor: Christopher A Horne, Wilmington, NC (US)

( * ) Notice: Subject to any disclaimer, the term of this patent is extended or adjusted under 35 U.S.C. 154(b) by 0 days.

(21) Appl. No.: 13/419,837

(22) Filed: Mar. 14, 2012

(65) Prior Publication Data

US 2012/0233898 A1 Sep. 20, 2012

Related U.S. Application Data

(60) Provisional application No. 61/465,211, filed on Mar. 16, 2011.

(51) Int. Cl.
*A47G 1/16* (2006.01)

(52) U.S. Cl.
USPC ..... 40/757; 248/476; 248/477

(58) Field of Classification Search
USPC ..... 248/466, 475.1, 477, 497, 498, 476, 248/489, 493, 495; 40/606.14, 770, 768, 40/617
See application file for complete search history.

(56) References Cited

U.S. PATENT DOCUMENTS

| | | | | |
|---|---|---|---|---|
| 4,216,936 | A | 8/1980 | DeSelms | |
| 4,591,125 | A | 5/1986 | Bellehumeur | |
| 4,641,807 | A | 2/1987 | Phillips | |
| 5,443,238 | A | 8/1995 | Mitchell | |
| 5,480,120 | A | 1/1996 | Bruner | |
| 5,605,313 | A | 2/1997 | Erickson et al. | |
| 5,743,507 | A | 4/1998 | Rushing | |
| 5,836,565 | A | 11/1998 | Chang | |
| 5,878,987 | A | 3/1999 | Hayde | |
| 5,933,996 | A | 8/1999 | Chang | |
| 5,947,438 | A | 9/1999 | Lemire | |
| 6,062,525 | A | 5/2000 | Lemire | |
| 6,170,181 | B1 * | 1/2001 | Groner | 40/1.6 |
| 6,663,075 | B2 | 12/2003 | Zuller | |
| 6,666,425 | B1 | 12/2003 | Ferguson | |
| 7,607,631 | B2 | 10/2009 | Newman | |
| 7,891,124 | B1 | 2/2011 | Willis | |
| 7,950,617 | B2 * | 5/2011 | Zhu et al. | 248/469 |
| 8,336,843 | B2 * | 12/2012 | Gulbrandsen et al. | 248/317 |
| 2006/0186304 | A1 * | 8/2006 | McGee | 248/476 |
| 2007/0075211 | A1 | 4/2007 | Potter | |
| 2007/0295879 | A1 * | 12/2007 | Wong | 248/475.1 |

* cited by examiner

*Primary Examiner* — Joanne Silbermann
*Assistant Examiner* — Shin Kim
(74) *Attorney, Agent, or Firm* — MacCord Mason PLLC

(57) ABSTRACT

A picture frame having an adjustable back assembly enabling vertical, horizontal and rotary adjustment of the frame position on a wall is described. The frame back is sized to fit into a recess in the picture frame back, and includes an inner plate, an outer plate having an opening, an intermediate plate frictionally held between said inner and outer plates and slidable therebetween. The intermediate plate has an outer face and is smaller than the outer plate and larger than the outer plate opening. A first hanger member is secured to the outer face of the intermediate plate and extends outwardly through the opening. A second hanger member is attachable to a wall and can be joined to the first hanger member to mount the picture frame on the wall. The picture frame can be pushed up or down or rotated to adjust the picture frame position.

20 Claims, 2 Drawing Sheets

ADJUSTABLE FRAMED PICTURE HANGER BACK

This application claims the benefit of the filing date of U.S. Provisional Patent Application No. 61/465,211, filed Mar. 16, 2011, which is incorporated herein in its entirety.

BACKGROUND OF THE INVENTION (1) Field of the Invention

The present invention relates generally to a device for hanging a framed picture, and in particular to a framed picture hanger that allows for vertical and/or horizontal adjustment of the framed picture on the wall, as well as rotation of the framed picture.

(2) Description of the Prior Art

In the hanging of a framed picture, the term encompassing framed pictures including photographs, a nail, hook or other wall attachment is typically attached to the wall on which the picture is to be hung, a wire or other fastener is attached to the back of the framed picture, and the wire or fastener is then attached to the nail or hook. The resultant position of the picture is often different from that desired.

Precise mounting of a framed picture is virtually impossible since the exact relationship of the picture to the wall attachment cannot be seen until the picture is actually mounted. Then, it is often determined that the picture is either too low, too high, too far to the left, or too far to the right. Correction requires the time consuming task of placing the wall attachment in a different location, which also results in additional holes in the wall.

Pictures, while initially horizontally mounted, often become skewed or tilted over time due to normal movement of the building or by being struck by passersby. Thus, the picture must also be rotatable so that it can again be horizontally leveled.

This need has long been recognized and numerous proposals have been put forward to resolve it. Some of these proposals are quite complex and expensive. Some permit only horizontal or vertical adjustment, or rotation of the picture. None are entirely satisfactory in addressing the problem. Therefore, there is a continuing need for a simple and inexpensive means for adjusting a framed picture so that the picture can be moved vertically and horizontally relative to the wall on which it is hung, as well as rotated to a horizontal orientation.

SUMMARY OF THE INVENTION

The present invention provides a means to address these needs. Generally, the present invention is a picture framing device, referred to herein as a hanger back, comprised of a multi-part picture frame back with a first section of a hanger assembly attached thereto, and second section of the hanger assembly for attachment to a wall to connect with the first section on the hanger back. The frame back is insertable into a recess in the back of a picture frame. When mounted on a wall, the picture frame is slidable and rotatable relative to the hanger assembly.

More specifically, the hanger back is comprised of a frame back with an inner plate, an outer plate having an opening, and a slidable intermediate plate frictionally held between the inner and outer plates. A first hanger section is attached to the outer face of the slidable plate, and extends outwardly through the opening in the outer plate. The inner and outer plates are attached at the edges, and the opening in the outer plate is substantially larger than the hanger section, permitting movement of the inner and outer plates to different positions and to rotate relative to the intermediate plate and hanger section.

The inner and outer plates are of the same dimensions and may be sized differently to fit within the recesses in the backs of picture frames. Standard picture frames include a rear recess to receive the components of the picture, i.e., the glass, picture or photograph, any spacers, and the back or easel. The recess sizes of standard picture frames are, for example, 8×10, 9×12, 11×14, 12×15, etc. Picture frames are also made in custom sizes. The present invention is designed to fit within the picture frame recess on the outside of the other components in replacement of the conventional back or easel (also known as an easel back).

Various designs of hanger assemblies may be used within the scope of the present invention. A hanger assembly is comprised of a hanger back section and a wall section that are releasably attachable to each other. Preferably, the hanger assembly is comprised of a male section having a hook, and a female section with an opening to receive the hook. In the preferred embodiment, the male section is attached to the intermediate plate with the hook projecting downwardly, while the female section is attached to the wall. The picture frame is then mounted on the wall by simply inserting the male hook into the opening in the other section. Alternatively, the male section can be mounted on the wall, with the female section being attached to the intermediate plate.

In order to hold the sections in engagement and the framed picture on the wall during adjustment of the position of the frame picture, the sections may include a releasable latching member or stop. For example, the hook on the male section may be inwardly flexible with a curvature adjacent its distal end so that the distal end of the hook will engage the edge of the female member to prevent detachment. However, the hook can be flexed to disengage the hook when separation of the framed picture from the wall is desired.

The components of the frame back can be manufactured of various materials within the knowledge of one skilled in the art. For example, the back plates can be made of cardboard or plastic sheet, while the hanger assembly can be made of molded plastic. Normally, the inner and outer sheets will be glued together about at least a part of their abutting peripheries with a conventional adhesive, although heat sealing is also contemplated if plastic plates are used. Double-sided tape can also be used to secure the inner and outer plate peripheries.

The proximity of the inner and outer plates will normally be sufficient to provide sufficient frictional engagement of the intermediate plate so that the plate will remain in the desired position. However, the frictional engagement can be increased if desired by increasing the abrasiveness of the inner face of the intermediate sheet and/or of the outer face of the inner sheet. For example, one or both faces can be covered with an abrasive sheet, e.g., sandpaper.

In operation, the hanger back with one section of the hanger assembly, e.g., the male section, is fitted in the recess in the rear of the framed picture, and the other section of the hanger assembly is attached to the wall at the approximate location where the framed picture is to be hung. The framed picture is then hung on the wall by inserting the male section hook into the opening in the female section.

If the position of the framed picture is not optimal, e.g., if it is too high or low, or too far to one side or the other, the user needs only to push the framed picture along the wall in the desired direction. When doing so, the intermediate plate remains stationary, while the inner and other plates as well as the framed picture slide relative to the intermediate plate and hanger assembly. As a result, the framed picture is repositioned while remaining attached to the wall without the need to move the hanger attachment section on the wall.

If the upper edge of the framed picture is not horizontal at the time the framed picture is hung, or later becomes tilted, the user can simply rotate the framed picture back to horizontal. When rotated, the intermediate plate and hanger assembly remain stationary, with the inner and outer plates and other components of the framed picture being rotated relative to the intermediate plate.

Thus, the hanger back of the present invention, while economical to manufacture and simple to use, provides significant advantages over prior art adjustable framed picture hangers, allowing for vertical, horizontal and rotational adjustment of the framed picture without removing the framed picture from the wall.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
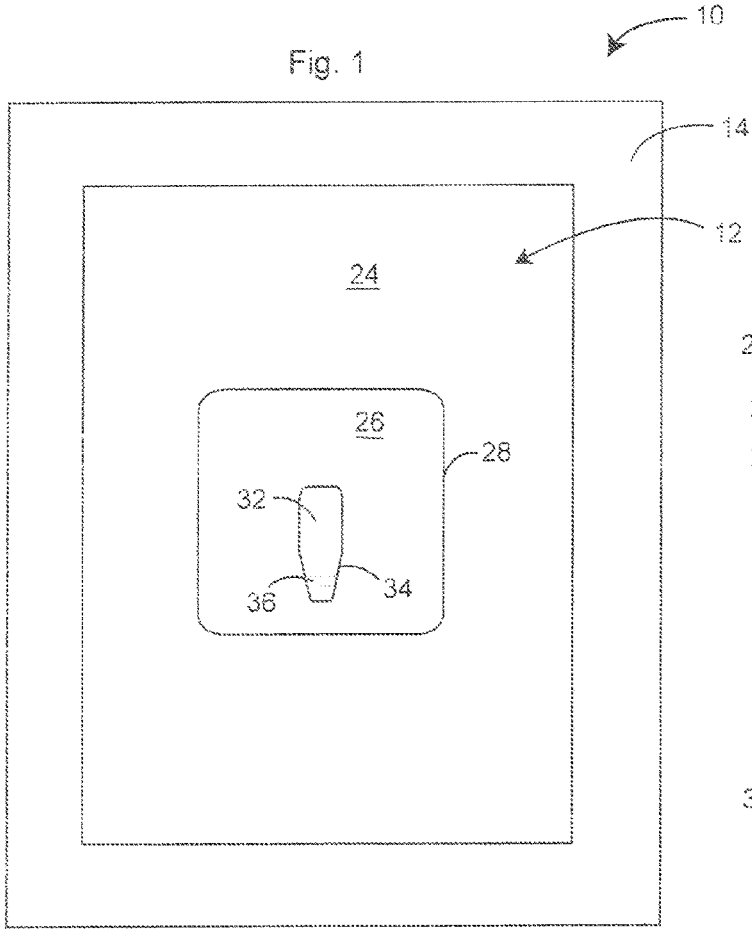
FIG. 1 is a rear view of a framed picture with the hanger back installed.
Figure 2:
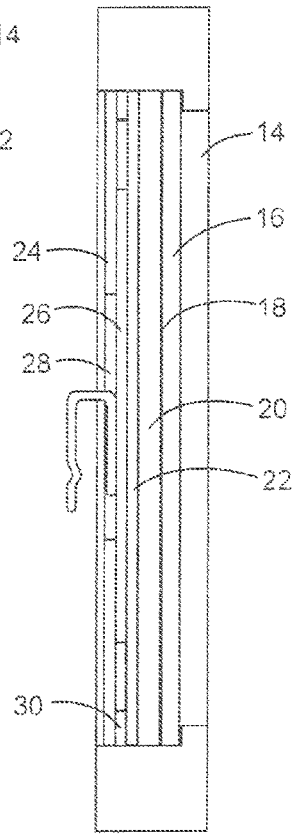
FIG. 2 is a sectional side view of a framed picture with hanger back installed.
Figure 3:
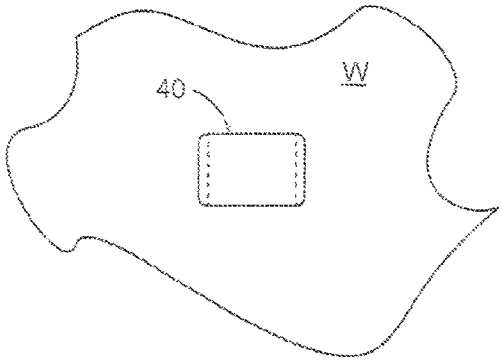
FIG. 3 is a detailed front view of the female section of the hanger assembly.
Figure 4:
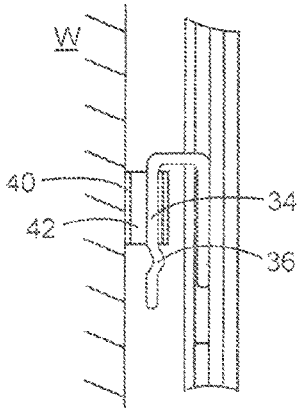
FIG. 4 is a detailed side view of the hanger assembly.

FIGS. 1 and 2 illustrate a framed picture, generally 10, comprised of a frame back, generally 12, mounted within the back recess of a picture frame 14. Frame back 12 is shown mounted in the recess behind a glass pane 16, a picture or photograph 18, and a spacer 20. It will be understood, however, that the glass pane and/or spacer is not part of the invention and may not be used in some framed pictures.

Frame back 12 is comprised of an inner plate 22, an outer plate 24, and an intermediate plate 26 frictionally and slidably held between plates 22 and 24. Outer plate 24 includes an opening 28, which is shown as a square with radiused corners. It will be understood, however, that opening 28 may be of other shapes, e.g., rectangular or circular. Plates 22 and 24 are secured to each other around their peripheries by adhesive 30.

Plates 22 and 24 and are rectangular and are equally sized to fit the rear recess of frame 14. Intermediate plate 26 may be of different shapes and is preferably the shape of opening 28. The dimensions of intermediate plate 28 are greater than the dimensions of opening 28 and less than the dimensions of plates 22 and 24.

Male section 32 of a hanger assembly is mounted centrally on the outer face of intermediate plate 26 and extends through opening 28 to the rear of frame back 12. Male section 32 includes a downwardly extending, flexible arm 34, which has an inwardly projected stop 36 near its lower end.

Female section 40 of the hanger assembly is shown attached to wall W. Section 40 includes a vertical opening 42 into which hook 34 is inserted. When hook 34 is inserted into opening 42 and is in the unflexed state, stop 36 extends beneath the front wall of section 40, preventing removal of section 32, and thereby holding the framed picture on the wall. However, when the lower tip of hook 34 is pushed inwardly, stop 36 is disengaged and hook 34 can be removed from section 40.

Figure 5:
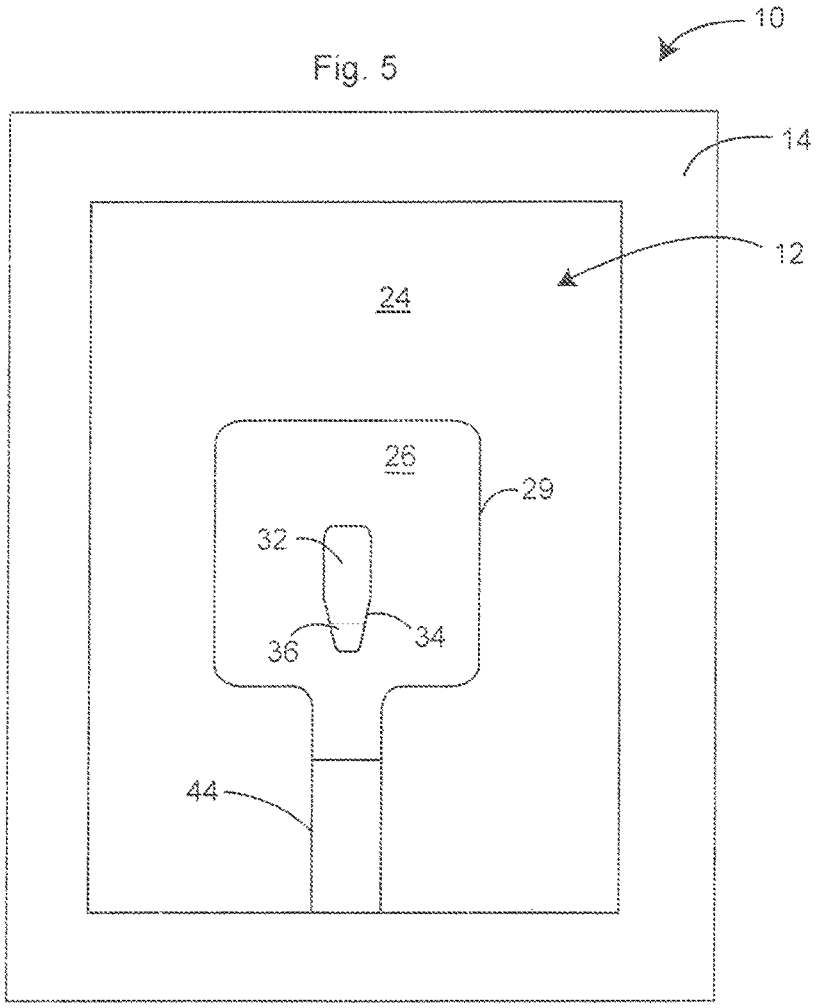
FIG. 5 is a rear view of a framed picture with a hanger back having an alternative opening.

FIG. 5 illustrates an outer plate with an alternative opening 29, that includes a slot 44 having a width at least equal to the width of hanger section 32, which allows the hanger section 32 to be moved toward the edge of outer plate 12 and to adjacent the bottom of the framed picture, thereby facilitating grasping and release of the hanger section 32 to release section 32 from wall hanger section 40, e.g., by flexing the tip of hook 34.

Figure 6:
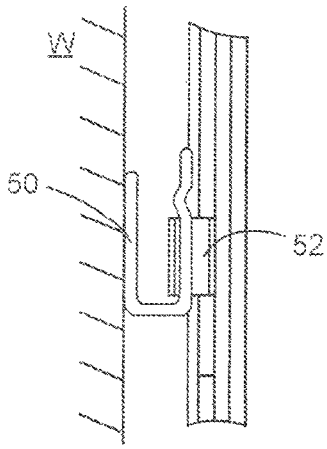
FIG. 6 is a detailed side view of an alternative hanger assembly.

FIG. 6 illustrates an alternative hanger assembly in which male section 50 is attached to wall W, and female section 52 is attached to the intermediate section of the frame back.

Framed picture 10 is mounted on the wall W by simply inserting hook 34 into opening 42 until stop 42 is engaged. Framed picture 10 can be adjusted up, down, or sideways by pushing framed picture 10 in the direction it is to be moved. When pushed, frame 14, plates 22 and 24 and the other components move in the direction framed picture 10 is pushed, except for intermediate plate 26 and attached hanger section 32, which remain stationary. Framed picture 10 can be moved in the desired direction until section 32 abuts the edge of opening 28. Similarly framed picture 10 can be rotated with all elements being rotated except for intermediate plate 26 and hanger section 32.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A picture frame back comprising:

a) an inner plate;

b) an outer plate having an opening;

c) an intermediate plate frictionally held between said inner and outer plates and slidable vertically, horizontally and rotatably therebetween, said intermediate plate having an outer face and being smaller than said outer plate and larger than said outer plate opening; and a hanger member secured to the outer face of said intermediate plate and extending outwardly through said opening.

2. The frame back of claim 1, wherein said inner and outer plates are the same size.

3. The frame back of claim 1, wherein said outer plate opening is rectangular.

4. The frame back of claim 1, wherein said hanger member includes a downwardly extending hook.

5. The frame back of claim 1, wherein said inner and outer plates are joined along their peripheries.

6. The frame back of claim 1, wherein said intermediate plate has at least one abrasive surface.

7. A picture hanger back comprising:

a) a hanger back including an inner plate; an outer plate having an opening; and an intermediate plate frictionally held between said inner and outer plates and slidable vertically, horizontally and rotatably therebetween, said intermediate plate having an outer face and being smaller than said outer plate and larger than said outer plate opening; and b) a hanger assembly including a first hanger member secured to the outer face of said intermediate plate and extending outwardly through said opening; and a second hanger member attachable to a wall and releasably attachable to said first hanger member.

8. The hanger back of claim 7, wherein said inner and outer plates are the same size.

9. The hanger back of claim 7, wherein said outer plate opening is rectangular.

10. The hanger back of claim 7, wherein one of said hanger members includes a hook and the other hanger member includes an opening for insertion of said hook.

11. The hanger back of claim 7, wherein said inner and outer plates are joined along their peripheries.

12. The hanger back of claim 7, wherein said outer plate opening includes a slot with a width at least equal to the width of said first hanger member extending from the central opening toward the edge of the outer plate.

13. The hanger back of claim 7, wherein one of said hanger members includes a releasable latching member to secure said hanger members together.

14. A picture frame and adjustable back assembly enabling vertical, horizontal and rotary adjustment of the frame position comprising:

a) a picture frame having a back receiving recess;

b) a picture frame back insertable into said recess, said back including an inner plate; an outer plate having an opening; an intermediate plate frictionally held between said inner and outer plates and slidable vertically, horizontally and rotatably therebetween, said intermediate plate having an outer face and being smaller than said outer plate and larger than said outer plate opening; and a hanger member secured to the outer face of said intermediate plate and extending outwardly through said opening.

15. The assembly of claim 14, wherein said frame back inner and outer plates are sized to fit into said frame recess.

16. The assembly of claim 14, wherein said frame back outer plate opening is rectangular.

17. The assembly of claim 14, wherein said frame back hanger member includes a downwardly extending hook.

18. The assembly of claim 14, further including a wall mountable hanger member releasably attachable to said frame back hanger member.

19. The assembly of claim 14, wherein said inner and outer plates are joined along their peripheries.

20. The assembly of claim 14, wherein said intermediate plate has at least one abrasive surface.

* * * * *